US006763676B2

(12) United States Patent
Jones et al.

(10) Patent No.: US 6,763,676 B2
(45) Date of Patent: Jul. 20, 2004

(54) BEVERAGE DISPENSER

(76) Inventors: Brian C. Jones, 22 Farmington River Turnpike, New Hartford, CT (US) 06057; Scott J. Sullivan, 1918 70th Ave., Dresser, WI (US) 54009; Peter J. Currier, 31 Summer St., Torrington, CT (US) 06790; Russell J. Duchene, 83 Pythian Ave., Torrington, CT (US) 06790; Amir Farooqui, 206 Village Dr., Torrington, CT (US) 06790; Tim C. Rothwell, 3159 Saybrook Ct., Dublin, OH (US) 43017; Allen L. Rogala, 122 Tara Dr., Torrington, CT (US) 06790

( * ) Notice: Subject to any disclaimer, the term of this patent is extended or adjusted under 35 U.S.C. 154(b) by 0 days.

(21) Appl. No.: 10/368,323

(22) Filed: Feb. 19, 2003

(65) Prior Publication Data

US 2003/0217564 A1 Nov. 27, 2003

Related U.S. Application Data

(62) Division of application No. 09/787,174, filed on Apr. 30, 2001, now abandoned.

(51) Int. Cl.[7] ..... B67D 5/62

(52) U.S. Cl. ..... 62/392; 62/393; 62/394

(58) Field of Search ..... 62/59, 386, 389, 62/390, 391, 392, 393, 394; 26/396

(56) References Cited

U.S. PATENT DOCUMENTS

| | | | | | |
|---|---|---|---|---|---|
| 3,892,335 | A | * | 7/1975 | Schroeder | 222/129.1 |
| 4,651,862 | A | * | 3/1987 | Greenfield | 194/344 |
| 4,742,939 | A | * | 5/1988 | Galockin | 222/68 |
| 4,801,048 | A | * | 1/1989 | Credle et al. | 222/129.1 |
| 4,916,910 | A | * | 4/1990 | Schroeder | 62/59 |
| 6,123,232 | A | * | 9/2000 | Donselman et al. | 222/185.1 |

FOREIGN PATENT DOCUMENTS

JP 411178717 A * 7/1999

* cited by examiner

*Primary Examiner*—William E. Tapolcai
*Assistant Examiner*—Mohammad M. Ali
(74) *Attorney, Agent, or Firm*—Pyle & Piontek

(57) ABSTRACT

The present invention is a beverage dispenser 10 that can be assembled virtually entirely by hand without the need for hand or power tools. Exterior cladding panels 14, 50, 52, 54 and 70 thereof provide for interlocking assembly. A new ice bank evaporator structure 46, baffle 28 and method of ice bank control are also shown. In addition, dispenser 10 includes a merchandising cover 100 that permits for quick low cost conversion from an opaque display to one utilizing a back-lit transparency 120. Dispenser 10 further includes a molded plastic box 146 releasably securable to the base panel 14 thereof for retaining syrup pumps 134 therein for permitting quick access thereto.

17 Claims, 13 Drawing Sheets

50
50a
50b
50b
51
14a
14b
14c
14c
94
92
90
90a
18
18
17
16a
16a
16a
16b
16b
16c
16c
16d
16d
16d
16e
16e
32e
32e

52'
52e
52b
52b
52c
A
50b
16c
52a
50b
50
16d
16c
16c
18
17
90
14
16c
52b
16e
18
16

70
70a
76a
82
54b
54b
54a
62
78
74
76
54c
55
57
54
70b
78
60
60
66
70c
88
86
64
89
50
4A
16d
16
4A
16d
18
16c
12
13
17
90
14

BEVERAGE DISPENSER

The present application is a co-pending divisional based upon U.S. Ser. No. 09/787,174, filed Apr. 30, 2000, now abandoned.

BACKGROUND OF THE INVENTION

1. Field of the Invention

The present invention relates generally to beverage dispensers, and in particular to beverage dispensers designed for ease of assembly and maintenance and that provide for efficient cooling.

2. Background

Beverage dispensers are well known in the art and are generally of the post-mix or pre-mix variety. As is known, post-mix dispensers mix carbonated or flat water at a particular ratio with a concentrated syrup to produce a finished drink. Pre-mix dispensers simply dispense a finished drink that has been previously produced and filled into pre-mix containers at a beverage bottling facility. Such dispensers include means for cooling the beverage or the separate beverage constituents and a plurality of valves for dispensing thereof. In the case of electrically cooled post-mix dispensers, a refrigeration system including a compressor, condenser and evaporator are typically used to cool a water bath. The evaporator is positioned in the water bath and cooled to from a layer of ice or ice bank thereon to provide for a cooling reserve. The beverage constituents flow through heat exchange lines retained in the water bath for cooling thereof as they flow to the dispensing valves. The compressor and condenser and associated electrical components are generally secured by screws or bolts to a plate that is itself fastened to the top of the water bath tank.

A problem with prior art dispensers of the type described above concerns the time required for assembly thereof. Assembly times can exceed eight hours per dispenser resulting in relatively high labor costs. A large part of the labor input concerns the securing together of the various parts, generally using fastening means such as screws manipulated either manually, with hand tools, or with the use of power tools. It would be highly desirable to reduce or eliminate such time consuming means of fastening. However, the substitute means for attaching must have or approximate the strength, flexibility of application and durability of screw attachment approaches.

A further problem concerns the exterior surfaces of such dispensers. As is well known, beverage dispensers come in various sizes depending upon the numbers of individual valves provided by the particular machine and the volume of beverage that the dispenser is designed to handle at peak dispense times. With respect to varying the number of valves, the dispenser gets wider in a horizontal direction with an increase in the number thereof as the valves are installed side-by-side horizontally. Prior art dispensers have exteriors that include sheet metal panels that do not easily provide for any commonality of assembly of such exterior components between dispensers of various sizes. Accordingly it would be desirable to have the various exterior surfaces of a beverage dispenser consist of components that can provide for such commonality. It would also be desirable for such components to be able to be assembled without the need of hand or power tools.

An additional problem with beverage dispensers concerns the ability of the exterior surfaces thereof to provide for point of purchase advertising thereon in a way that uses the maximum available surface area thereof. Many beverage dispensers are located in areas that are readily viewable by the consuming public. While this is obviously the case for machines of the "self-serve" variety that are operated by the individual consumer, this is also often the case for machines that are operated by service personnel. It has long been known to use the exterior surface of such dispensers for the placement thereon of advertisements as an enticement to consumers to purchase a beverage and also to inform the public as to the brand and flavors of products being dispensed. Unfortunately, changing such advertising artwork is not easily done. Especially, where the advertising graphics are applied directly to, for example, an exterior sheet metal housing of the dispenser, which housing is not made to be easily removed from the dispenser and/or which graphics are not easily removed from the housing surface. In dispensers utilizing roto-molded plastic ice bath tanks, the plastic exterior of such tanks forms a portion of the exterior surface of the dispenser. Unfortunately, such tank surfaces are not amenable to the placement thereon of advertising artwork due to surface irregularities inherent in the roto-molding process. Thus, approximately 50% of the exterior surfaces of such dispensers are not available for advertising display. Accordingly, it would be very desirable to have a dispenser that provides for the maximum utilization of the exterior surface area thereof for the purpose of advertising display. It would also be desirable to have a dispenser that can be easily converted from opaque graphic display to one utilizing a back-lit transparency.

A further problem with beverage dispensers concerns the efficiency of operation of the refrigeration system and the ice bank. As stated above, many such dispensers utilize an ice bath for retaining the evaporator for forming a volume of ice thereon. This ice bank provides for a cooling reserve that can be used during times of high cooling demand when beverages are being dispensed at a high rate. Thus, the refrigeration system does not have to be sized to provide for all of the cooling at such peak dispense times. However, a problem with such cooling strategy is the fact that ice is a relatively good insulator. Thus, the thicker the ice that forms on the evaporator the more the evaporator is insulated from cooling the bath water, resulting in less efficient cooling thereof. As a result thereof, there is a tradeoff between amount of cooling reserve and efficiency of operation of the evaporator. A further problem concerns the fact that as the ice bank grows on the evaporator tubes and bridges there between, less surface area of the formed ice is in thermal contact with the water bath. The less efficient cooling that occurs as a result of ice insulating the evaporator and reduction in the surface area of the ice bank reduces the cooling ability of the water bath with respect to heat exchange between it and the beverage constituent coils. Thus, beverage is not able to be cooled as efficiently as possible. Accordingly, it would be highly desirable to have an ice bank/evaporator structure and management strategy that maximizes heat exchange between the water in the water bath tank, the ice bank and the liquid beverage components in the product coils.

It is known in the prior art to use syrup pumps to move the beverage syrup from sources thereof to the post-mix valves. And, it is known to have the pumps located either exterior of the dispenser or located there within. However, the dispenser must generally be configured one way or the other at the factory. It would be desirable to have a dispenser that could be field configurable between an internal or external syrup pump configuration.

SUMMARY OF THE INVENTION

The present invention is a beverage dispenser that can be assembled virtually entirely by hand without the need for hand or power tools. In addition, a novel approach to forming the exterior surfaces thereof is provided. A new structure and method of ice bank construction and control is also shown.

The dispenser herein includes an ice bath tank for retaining a volume of water and in which an evaporator is positioned along with a carbonator and a plurality of water and syrup heat exchange tubes. The water bath tank includes four bottom legs having tabs that provide for sliding retaining cooperation with corresponding slots located in a dispenser base. A refrigeration deck includes slots for receiving tabs extending upward from the top end of the water bath. The water bath tabs include holes for cooperating with metal pins that insert therein for retaining the refrigeration deck in place on top of the water bath.

A rear panel is secured to the base by a snap fit therein and by slots receiving mounting pins extending from a top perimeter surface of the water bath tank. Two side panels are then slideably engaged with the base, the water bath tank and the rear panel. A top louvered panel is then slideably engaged with the side panels and the rear panel followed by the securing of a front panel to the side panels and the top panel. A single screw is used to secure the top panel to the front panel thereby retaining all the panels in place.

A refrigeration deck includes a plurality of slots for receiving therein tabs extending upward from a perimeter edge of the water bath tank. When the tabs are inserted therein, removable clips provide for retaining the deck to the top of the water bath tank. An evaporator coil is suspended from and below the refrigeration deck for positioning thereof in the water bath tank. The water bath tank retains a carbonator, a plurality of syrup cooling coils and a water cooling coil. The water coil is situated along a bottom surface of the water bath tank. A baffle plate is secured to a top surface of the water cooling coil pack and includes a central hole there through and angled edges around a perimeter thereof. A water pump and a compressor are releasably secured to a top surface of the deck by a clip and pin attachment. A condenser is also quickly removably secured to the top of the refrigeration deck by a shoulder and pin securing system. An agitator is quickly removably secured to the deck and drives a propeller secured to a drive shaft that extends into the water bath.

Those of skill will understand that the present invention can be assembled wherein the water bath tank can be secured to the base after which the syrup coils, carbonator, water coil pack and baffle can be assembled together and dropped into the water bath tank. Beverage dispensing valves and their connection points are fluidly connected to the water and syrup coils and are secured to and supported by a front portion of the water bath tank. The refrigeration deck includes a deck plate having releasably secured to a top surface thereof various components including the evaporator, condenser, compressor and agitator. An evaporator is secured to a bottom surface of the deck plate and suspended therefrom. The completed refrigeration deck is then lowered onto the water bath tank wherein it rests on a top perimeter edge thereof with the evaporator positioned within the interior volume thereof. Slots in the deck plate receive corresponding upright tabs extending from the top perimeter edge of the water bath tank for proper positioning fitting of the deck and tank together. Clips are attached to the water bath tank tabs for retaining the deck and tank together. The exterior panels can then be secured to the base and water bath tank in the manner and sequence as above described completing the assembly thereof. It can be appreciated by those of skill that the present invention provides for a greatly improved ease of assembly over prior art dispensers that rely essentially solely on screw fasteners. As a result thereof, the time of assembly is significantly reduced.

It can also be understood that having removable exterior plastic molded panels substantially reduces the cost of the dispenser compared to dispensers having an exterior housing made of stainless steel sheet metal. The molded plastic panels also lend themselves to greater design freedom with respect to the exterior configuration and appearance of the dispenser of the present invention as opposed to dispensers having a sheet metal exterior. In addition, substantially the entire expanse of the surface area of the back and side panels can be used for point of purchase graphics. Moreover, the side and back panels are not interrupted by seams or other discontinuities that would detract from the advertising graphics. It can also be appreciated that the side panels can be easily and inexpensively interchanged with other equivalent panels having new or different advertising artwork. The front panel can also be used in that regard and can be used to house a lighting fixture to provide for a back-lighted graphics transparency.

The exterior panel approach also permits a certain degree of modularity with respect to dispensers having different numbers of valves. It can be understood that the same size side panels can be used in a family of dispensers where the change in size is only with respect to side to side width, not height and front to rear depth.

Those of skill will understand that there are two primary beat transfer mechanisms which occur to create the efficient cooling of syrup and water contained inside the product coils. The first mechanism is the heat transfer between the ice, generally at a temperature of 32 ° F., and the bath water, generally at a slightly warmer temperature, typically 32–36 ° F. The second mechanism is heat transfer between the bath water and the syrup and water contained in the product tubes. The syrup and water are typically chilled from on entering temperature of 75–90 ° F. to a leaving temperature slightly above the bath temperature, e.g. 38 ° F. A limiting heat transfer factor is the heat transfer between the water and the ice. In order to enhance that heat transfer, the present invention uses a specifically designed evaporator wherein a thin ice approach is provided for. Ice grows in annular rings around the individual evaporator tubes, and the tubes are spaced at a distance great enough to discourage ice from bridging there between and instead grow in an annular fashion there around. This approach provides for maximum ice surface area exposed to the bath water. Ice thickness is also controlled to a minimum, resulting in a minimum resistance to heat transfer between the bath water and the refrigerant flowing inside the evaporator tubes.

In order to further maximize heat transfer to the product coils it is known to agitate the water. In the present invention a novel water directing or flow baffle is used in conjunction with an agitator. In the center of the baffle plate is a hole and along its edges are vanes that are angled upward towards the ice bank. Also, an essential aspect of the water bath design employs the placement of product coils below the ice bank at the bottom of the water bath with the baffle horizontally secured to a top surface of these bottom product coils. An agitator impeller is placed near the geometric center of the bath and the center hole of the flow baffle for creating a downward circulation of the water through the inside of the ice bank and toward the flow, baffle. The special geometry of the flow baffle causes a portion of the downward flowing water to be turned around and directed upward against the ice bank. The remainder of the downward flow is directed through the center hole and into the product coils. The flow baffle provides the ability to increase the heat transfer coefficient between the water and the ice. The amount of water that is turned upward and directed at the ice may be controlled through adjustment of the overall dimensions of the plate and the center hole size. Furthermore the upward flow direction may be optimized by adjustment of the geometry of the flow vanes. In general, as more water is directed upward against the ice, the heat transfer coefficient increases and the bath water temperature decreases and more closely approaches the ice temperature of 32 ° F. While more flow is directed upward against the ice, less flow is available to the product coils in the bottom of the water bath. However, this lower flow was not found to greatly reduce the heat transfer between the bath water and the product coils. It was found that the water flow over the product coils may be reduced to a relatively low level before a reduction in heat transfer occurs. The baffle approach provides the flexibility to find the optimal balance, given the size parameters of the particular dispenser, between the proportion of the total agitated downward flow that is returned to the ice bank and that is directed to the product coils. Thus, adjustment of hole size and vane angle can be understood to serve as an efficient and flexible means to optimally design the water bath flow parameters to provide highest level heat transfer in water baths of different sizes and shapes. As a result thereof, the dispenser of the present invention provides for drinks that are significantly colder than can be obtained in conventional dispensing systems.

The present invention includes a merchandising cover that permits for quick low cost conversion from an opaque display to one utilizing a back-lit transparency. A light power unit is releasably securable to a back surface of the merchandising cover after the cover has been detached from the dispenser. A reflective sheet metal sheet is retained within an internal area of the merchandising cover and serves to receive snap fitting light sockets from the power unit. A pre-existing power socket is positioned behind the merchandising cover to which the power unit is connected. The merchandising cover is then re-attached to the dispenser and a transparency is releasable secured to an external perimeter edge of the cover. Thus, the present invention provides for a "plug and play" low cost means for quickly and easily converting to a desirable lighted graphics display.

The present invention also provides for the option of having syrup pumps located therein. The molded plastic base is securable to a pump retaining box positioned there below. The box includes a plurality of syrup pumps secured to a drawer therein. The drawer is slideably engaged with the box and is accessible by a removable plate.

After removal of the plate, the drawer can be accessed and slid out of the box for facilitating repair or replacement of the pumps. By having a separate box securable to the base thereof, the dispenser can be easily retrofitted in the field with optional "internal" syrup pumps where that configuration is desired.

DESCRIPTION OF THE DRAWINGS

A better understanding of the structure, operation and the objects and advantages of the present invention can be had by reference to the following detailed description which refers to the following figures, wherein.

DETAILED DESCRIPTION OF THE PREFERRED EMBODIMENTS

Figure 1:
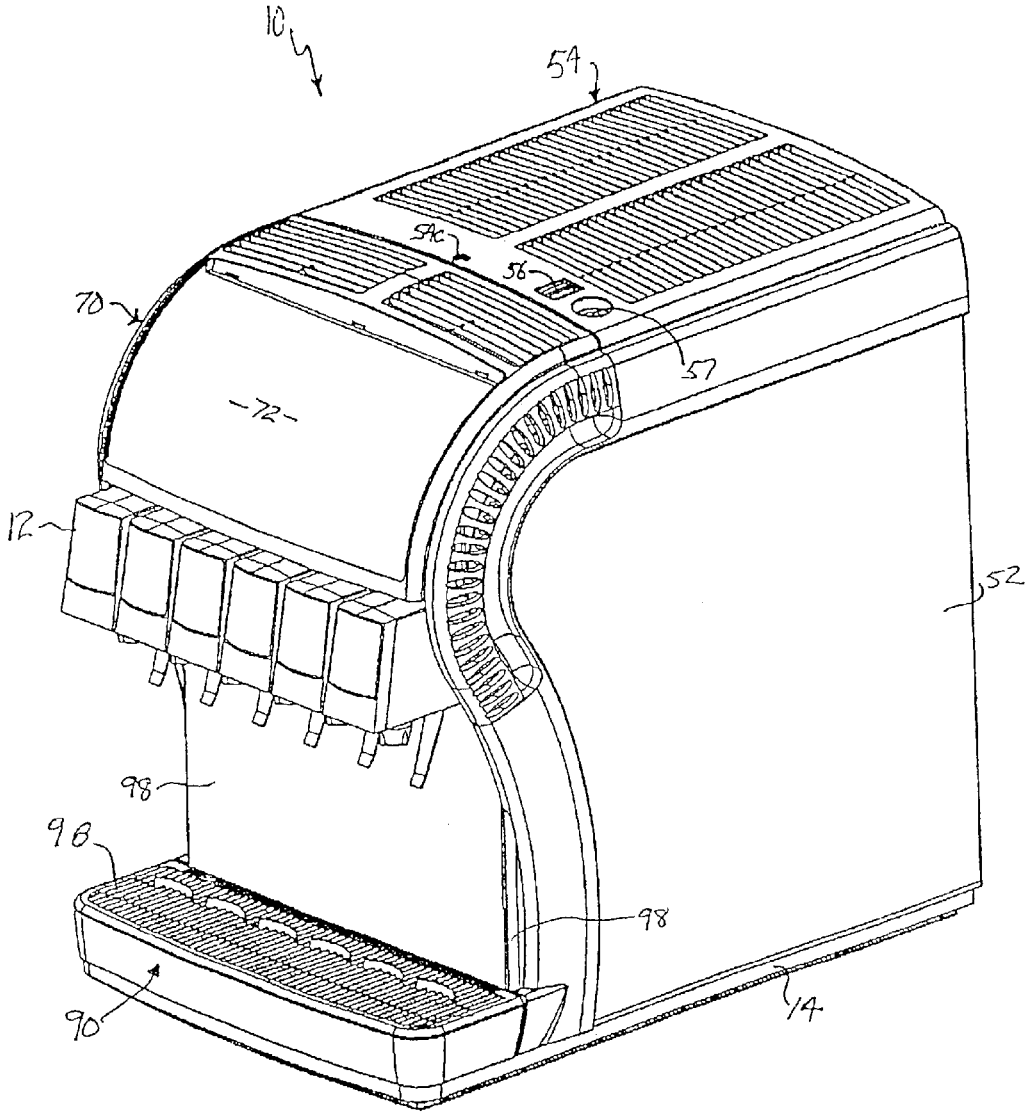
FIG. 1 shows a perspective view of the dispenser of the present invention.
Figure 2:
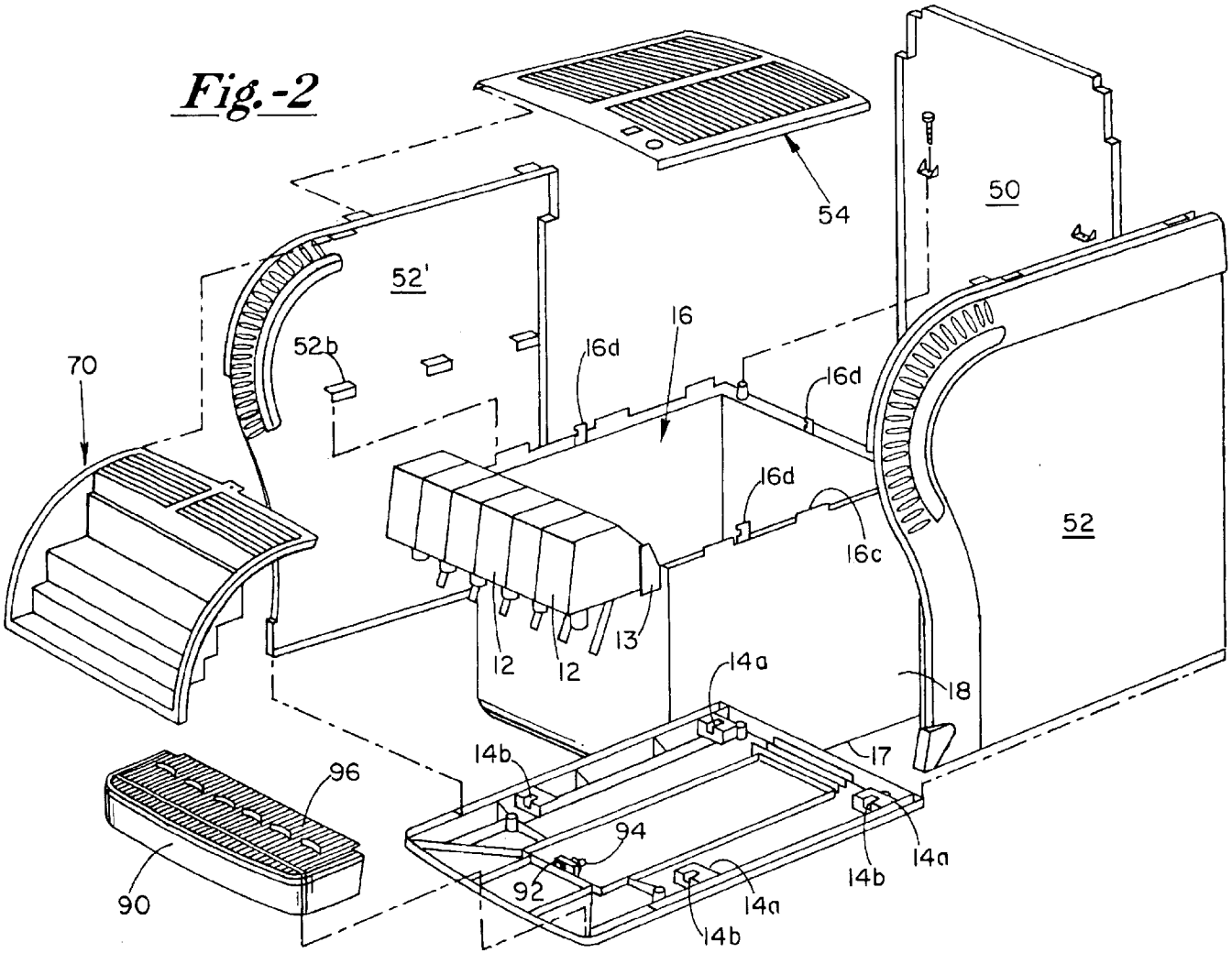
FIG. 2 shows an exploded view of the dispenser of the present invention.

The dispenser of the present invention is seen in the various figures and is generally referred to by the numeral 10. Dispenser 10 includes a plurality of beverage dispensing valves 12, such as of the post-mix variety, secured to and along a front surface thereof. In particular, valves 12 are secured to a valve support bracket 13. As seen in FIGS. 1–5, dispenser 10 includes a molded plastic base 14 and a molded plastic water bath tank 16. Base 14 has four upright legs 14*a* each having a receiving slot 14*b* defined therein. Tank 16 includes four legs 16*a* having insertion tabs 16*b*. Tank 16 is secured to base 14 by sliding insertion of tabs 16*b* into slots 14*b*. A sheet metal panel 17 is secured to tank 16 and extends over a front and bottom surface thereof. Bracket 13 is secured to panel 17. Tank 16 further includes foam insulating material 18 extending around the five exterior surfaces thereof Those of skill will understand that, prior to securing of base 14 to tank 16, insulation 18 is foamed in place while tank 16 and plate 17 are retained in a mold. After the insulation has set, it is formed onto and around tank 16 and between tank 16 and plate 17. Base 14 includes a panel receiving slot 14*c*. Tank 16 includes six panel receiving slots 16*c*. Tank 16 also includes three tabs 16*d* integral there with and extending upward from a perimeter edge 16*e* thereof.

As seen by referring to FIGS. 6, 7, 10 and 11, a stainless steel coil pack is generally referred to by the numeral 20. Coil pack 20 includes a serpentine water coil 22 and a plurality of serpentine syrup coils 24. A carbonator 26 is connected to sources of potable water and pressurized carbon dioxide. As is known in the art, syrup coils 24 are all individually connected a single post-mix valve 12 and to different syrup sources, not shown, by inlet ends 24*a* to provide for delivery of syrup to valves 12. A flow baffle 28 is secured to a top surface of water coil 22 by four wire twists 29 extending through holes 28*a* and around coils 22. Baffle 28 is made of stainless steel sheet metal and includes a central hole 28*b* and four angled vanes 28*c* around the perimeter thereof. Coil pack 20, carbonator 26 and baffle 28 are retained in water bath tank 16. Referring to FIGS. 6, 7, 7A, 8 and 9, a refrigeration deck is seen and generally referred to by the numeral 30. Deck 30 includes a rigid sheet metal base or platform 32 having two overhanging shoulders 32*a* and 32*b*, a plurality of upright pins 32*c*, three tank tab insertion slots 32*d* and two threaded retaining points or stand-offs 32*e* along a rear edge thereof. Base 32 serves to retain refrigeration and pump components on a top surface thereof in a manner that provides for their easy securing thereto and removal therefrom. In particular, a condenser/fan assembly 34 includes a base portion 35 having an inserting flange end portion 35*a* and a pin receiving hole, not shown, on a portion of flange 35 opposite from extension portion 35*a*. Condenser/fan 34 is secured to base 32 wherein flange portion 35*a* is inserted in and underneath overhang shoulder 32*a*. Condenser/fan 34 is then place flat against platform 32 wherein a pin 32*c* extends through the hole in flange 35. A clip 36 is then used to secure to the pin 32*c* thereby retaining condenser/fan 34 in place. In the present embodiment, pins 32*c* include holes, not shown, for releasably retaining the two resilient ends of retaining clips 36. A compressor 38 includes a base 38*a* having four holes for insertion there through of four pins 32*c*. A further four clips 36 provide for removable securing of compressor 38 to base platform 32. A water pump 40 includes a base having a flange end portion 40*a* also having four holes for cooperating four corresponding pins 32*c* for releasable securing to base 32 in the same manner as with compressor 38. An agitator motor 42 is conventionally secured to base 32 by a plurality of screws. A pair of handles 44 are secured to base 32 for facilitating the lifting of fully assembled deck 20.

Figure 3:
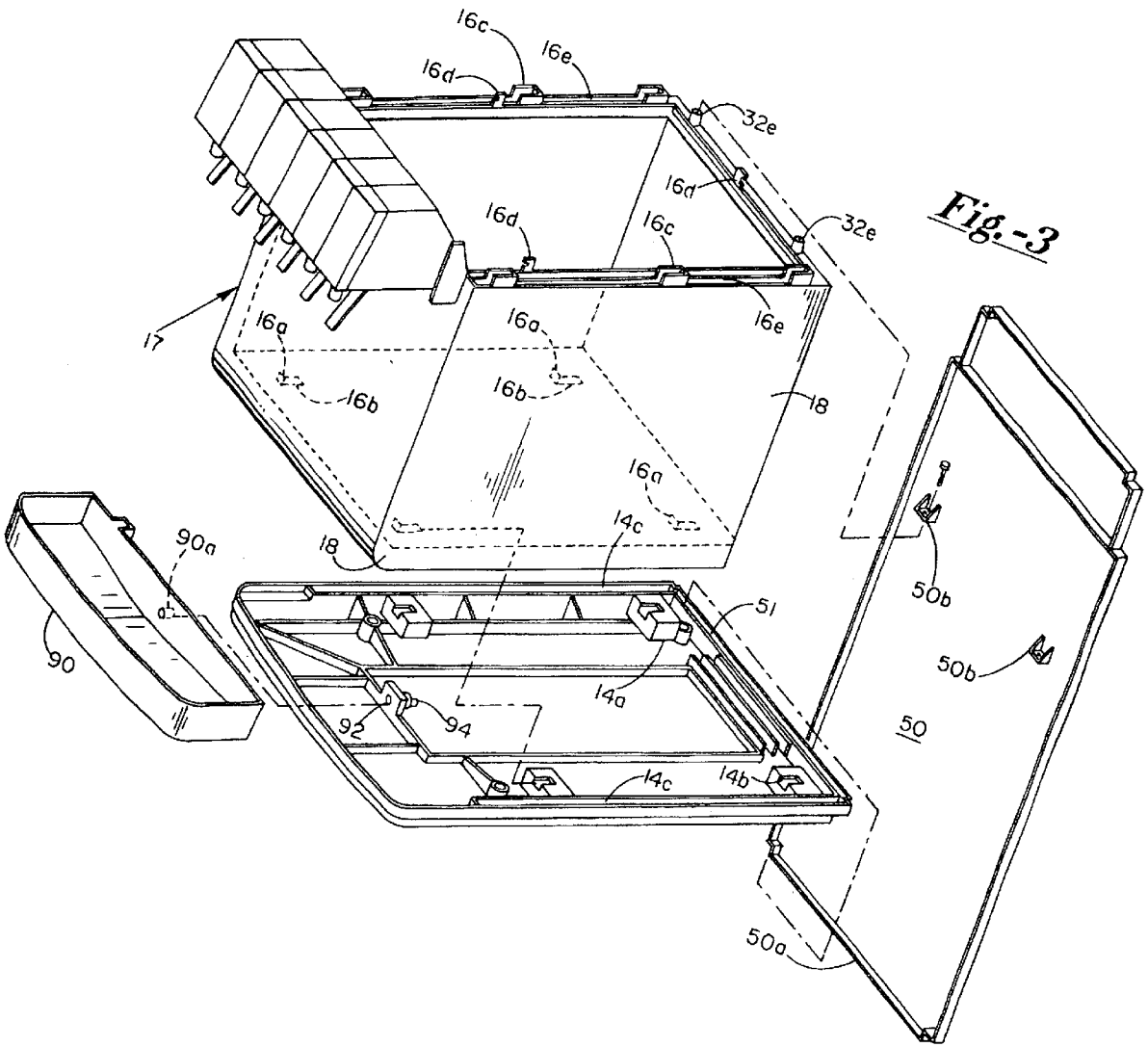
FIG. 3 shows a further exploded view of the dispenser of the present invention.
Figures 4, 4A:
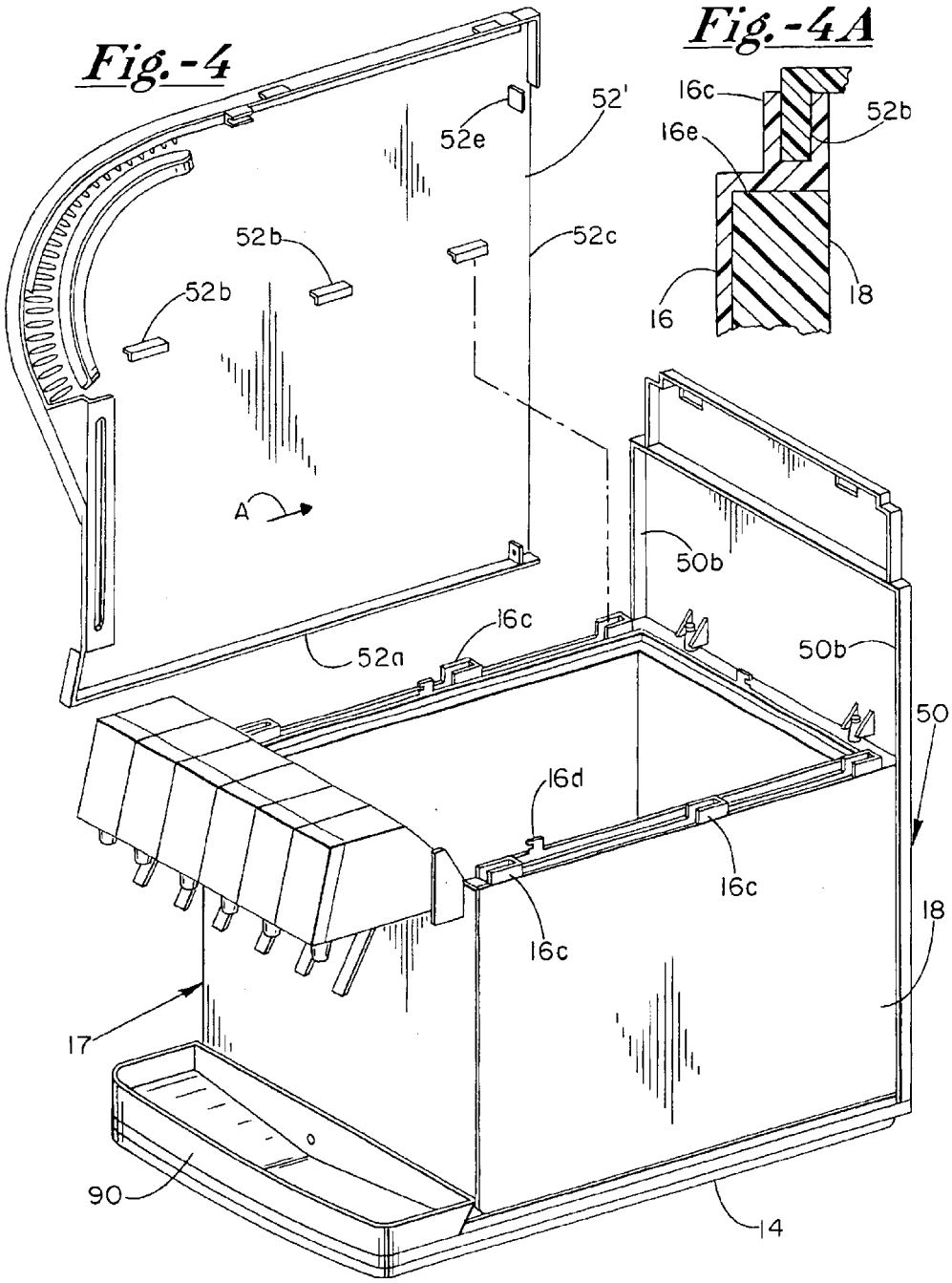
FIG. 4 shows a further exploded view of the dispenser of the present invention.
FIG. 4A shows an enlarged cross-sectional view along lines 4A—4A of FIG. 5.
Figure 5:
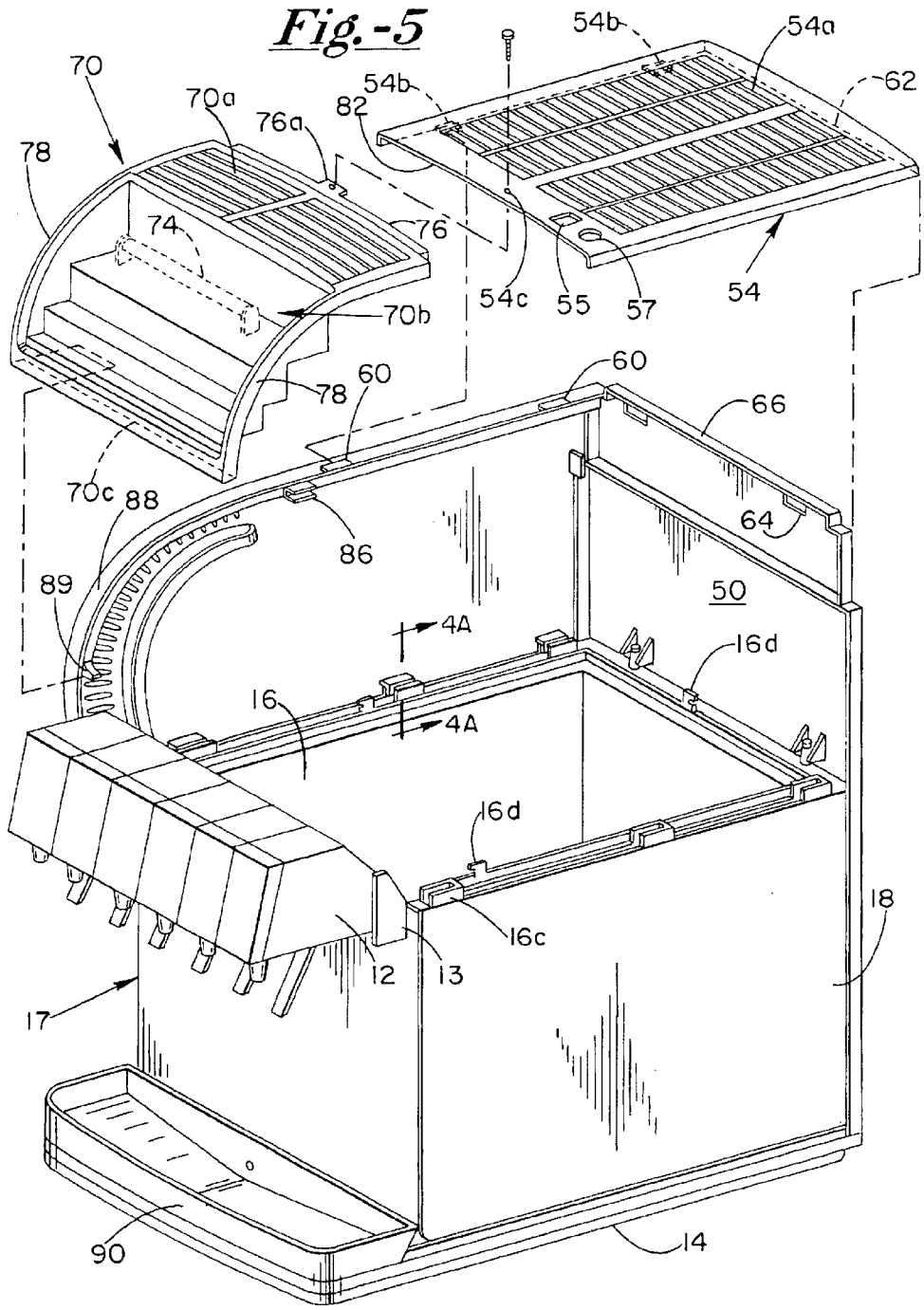
FIG. 5 shows a further exploded view of the dispenser of the present invention.
Figure 6:
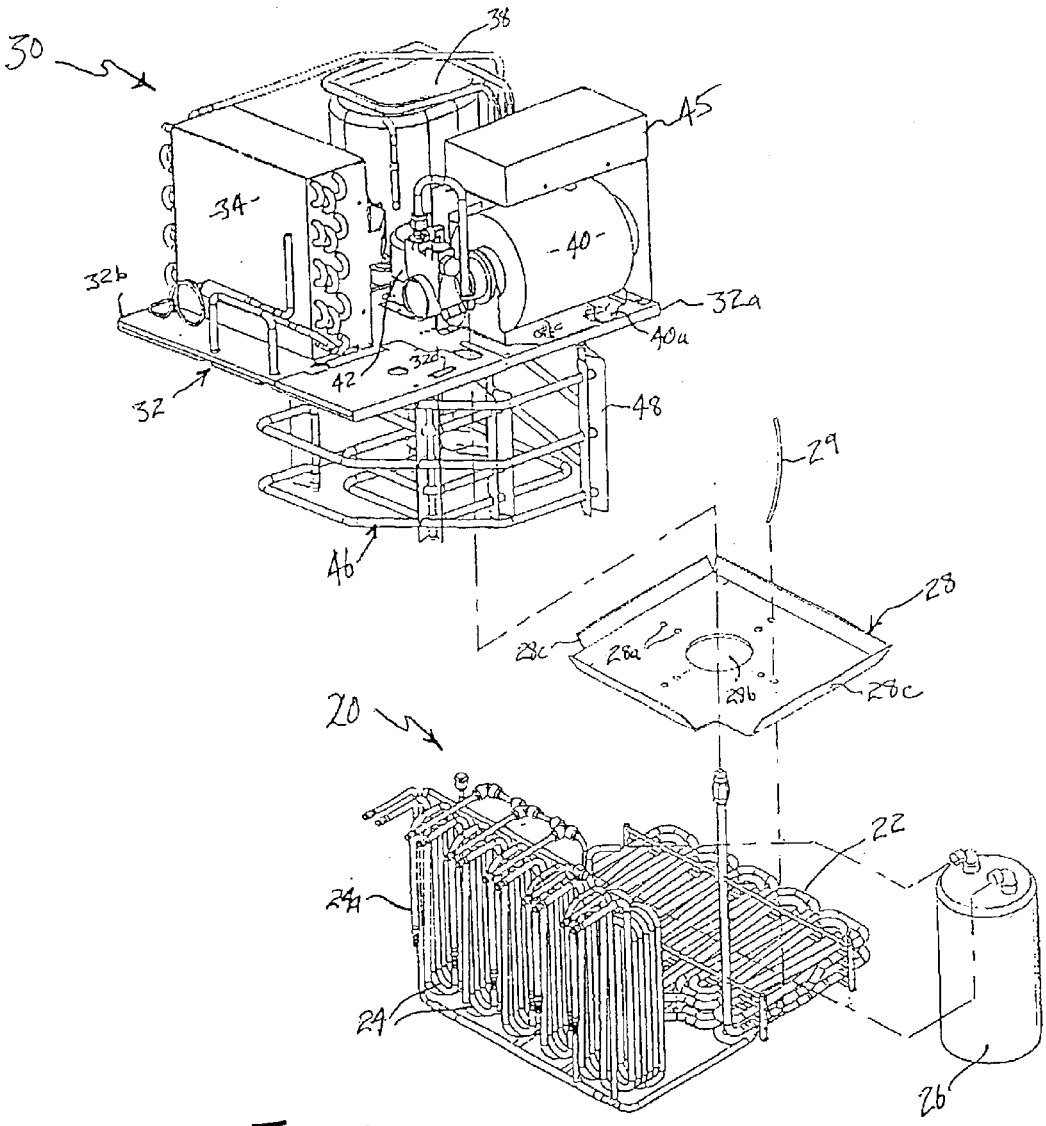
FIG. 6 shows an exploded view of the refrigeration deck, product coils, carbonator and flow baffle.
Figure 7:
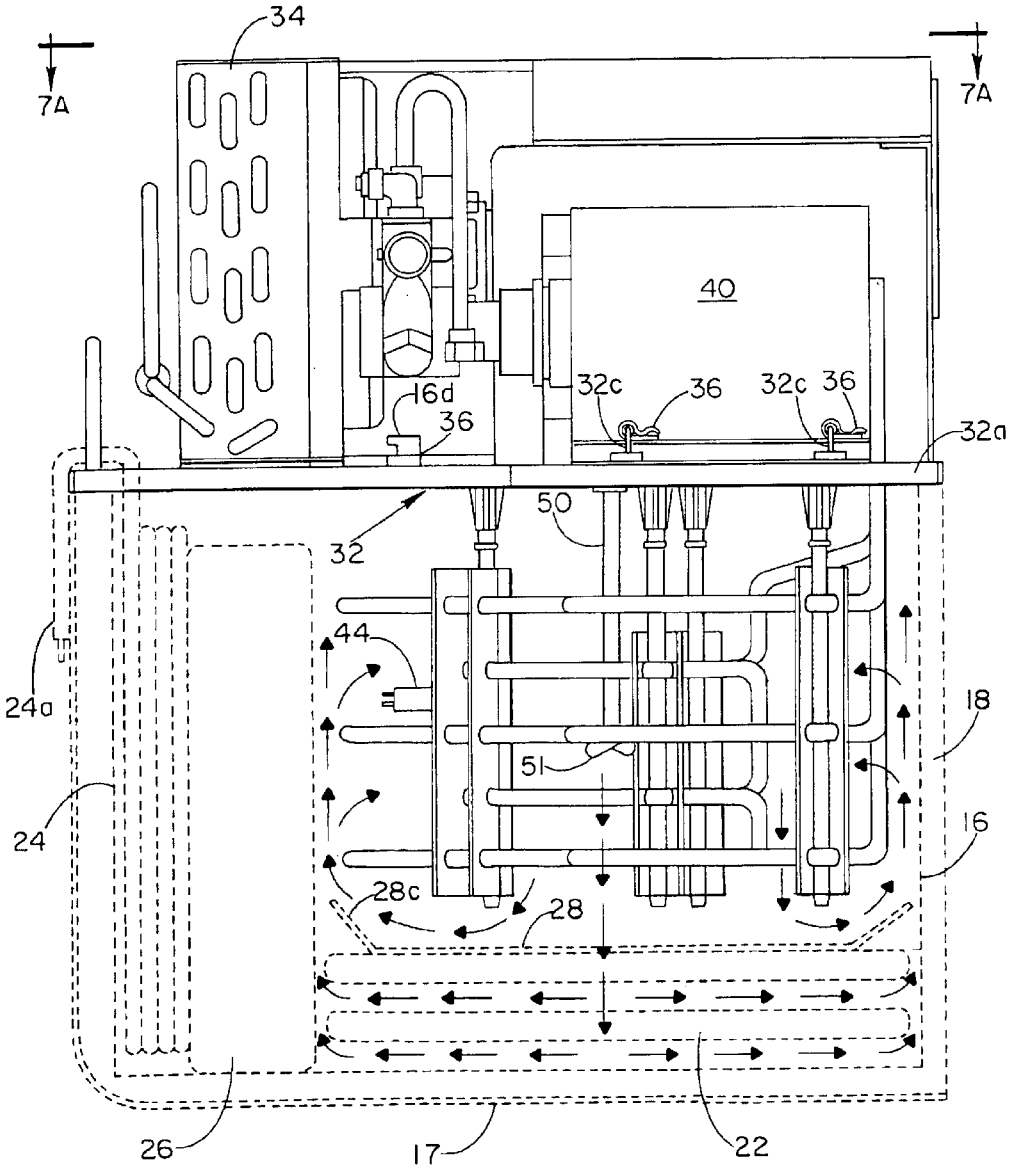
FIG. 7 shows a side plan view of the refrigeration deck.
Figure 7A:
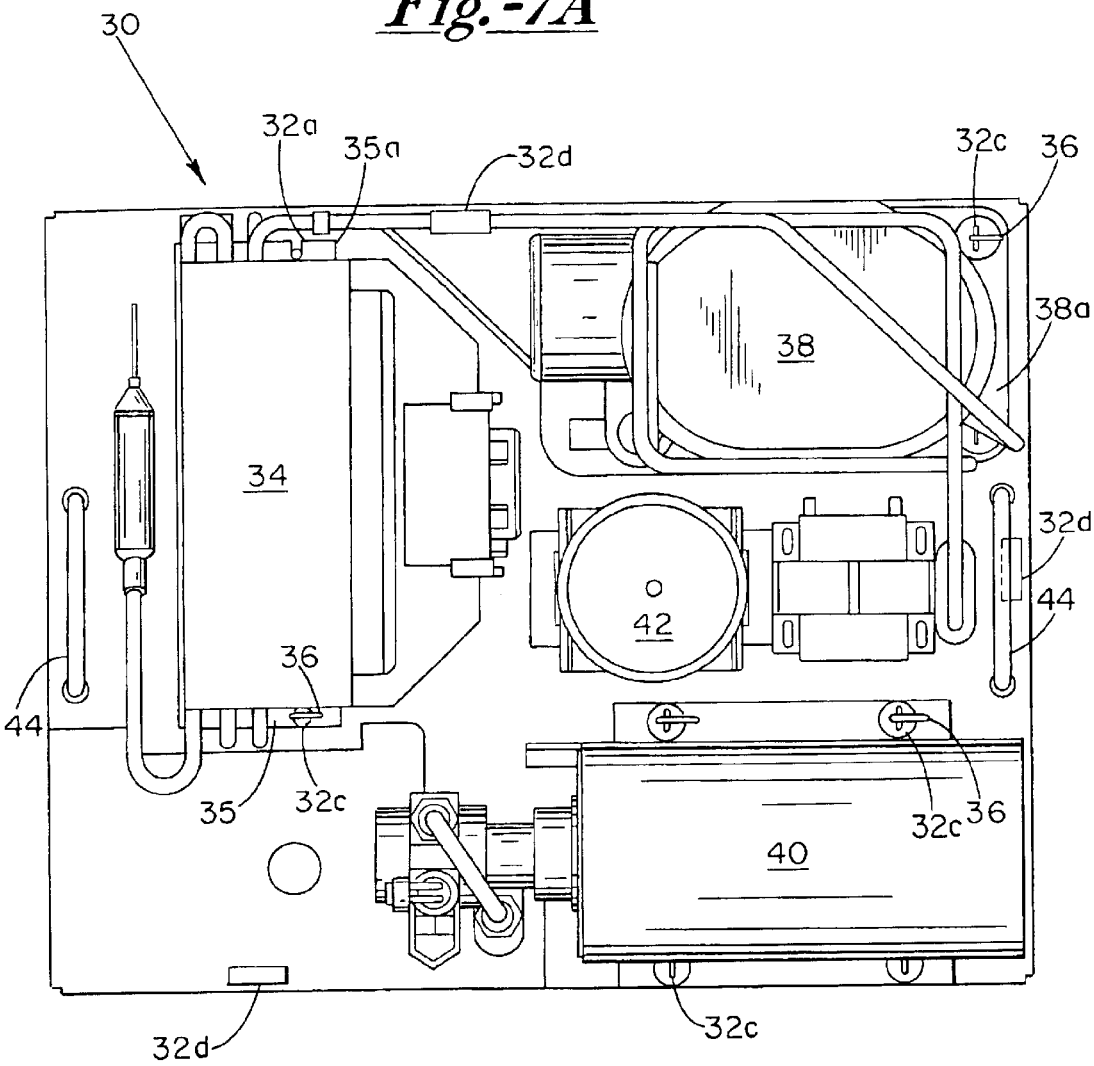
FIG. 7A shows a top plan view along lines 7A—7A of FIG. 7.
Figure 8:
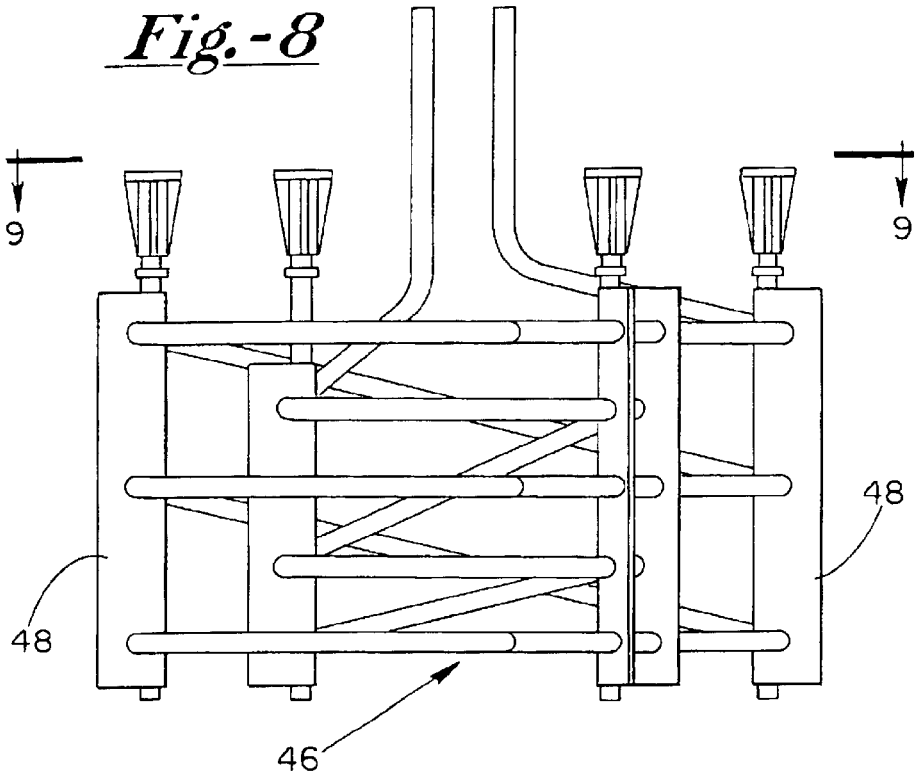
FIG. 8 shows an enlarged side plan view of the evaporator of the present invention.
Figure 9:
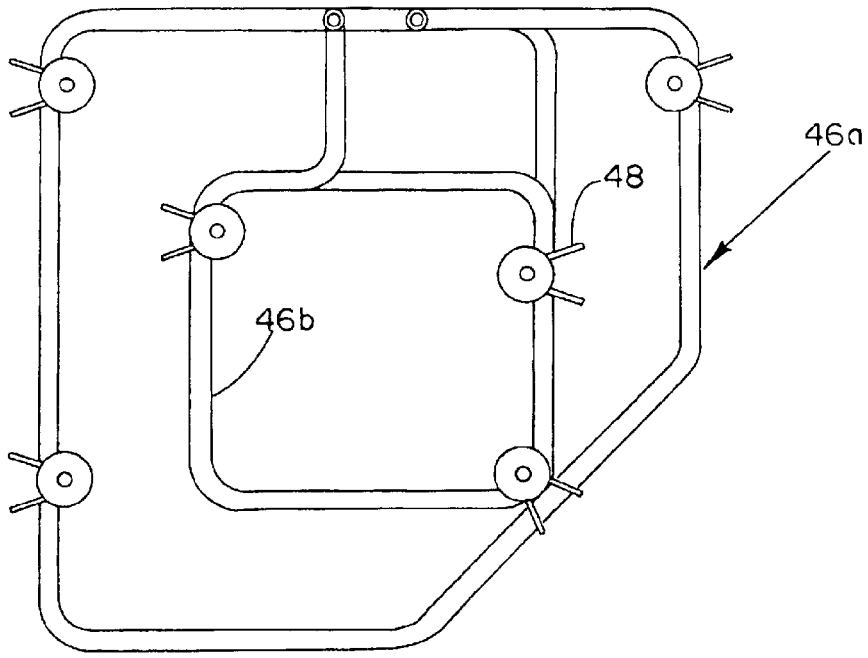
FIG. 9 shows a cross sectional view of along lines 9—9 of FIG. 8.
Figure 10:
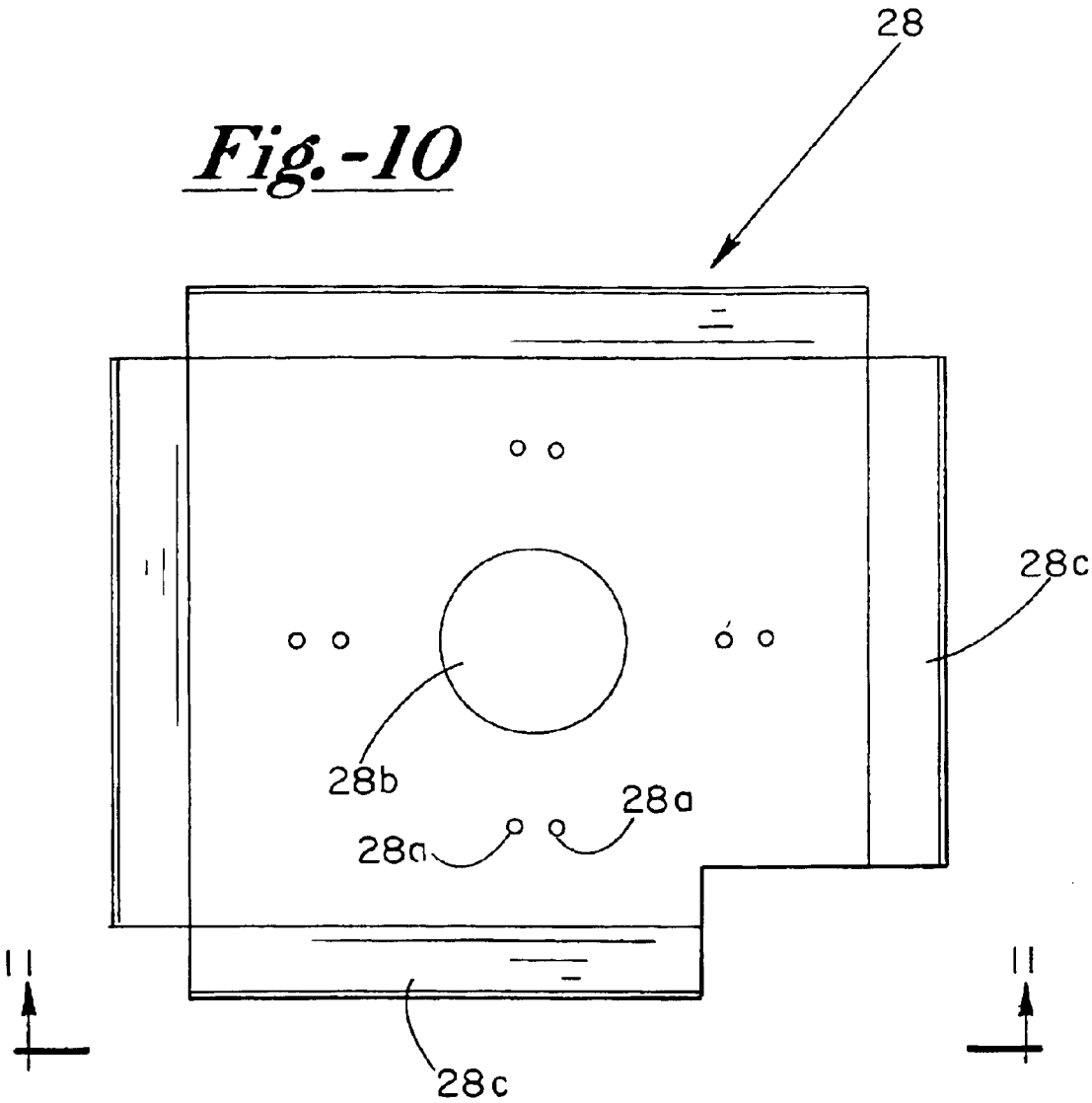
FIG. 10 shows a top plan view of the flow baffle of the present invention.
Figure 11:
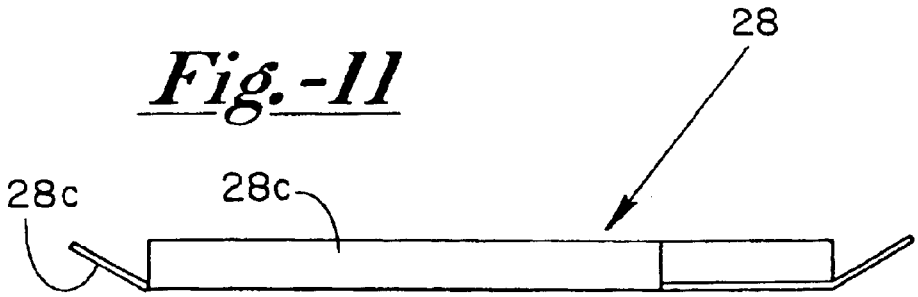
FIG. 11 shows an end plan view along lines 11—11 of FIG. 10.

As also seen in FIGS. 8 and 9, an evaporator 46 is secured to an underside of base 32 and includes a continuous refrigerant containing tube bent in a manner so as to define an inner coil portion 46*a* and an outer coil portion 46*b*. Spacers 48 are secured to base 32 and provide for retaining evaporator 46 in place and maintaining the proper spacing of the coils thereof. An ice bank sensor 49 of the conductivity type, well known in the art, provides for determining the size of ice on the coils of evaporator 46. As is known, such sensors include probes that determine the difference in conductivity between them as is caused by the presence there between of ice or water. A shaft 50, driven by agitator 42 includes an impeller 51 for imparting flow agitation to water retained in the water bath tank 16. Refrigeration deck 30 is secured to tank 16 wherein tabs 32*d* are inserted through corresponding slots 16*d*, after which clips 36 are used to retain deck 20 in place. Thus, after securing of deck 20 to tank 16, evaporator 46 is properly positioned within tank 16. As seen in FIGS. 1–5, it can be understood that dispenser 10 includes a plurality of exterior panels or cladding. These panels are essentially non-structural and are made of molded plastic and secured to dispenser 10 in the following manner. As seen in FIG. 3, a back panel 50 includes a bottom end 50*a* that is inserted in to a corresponding friction or tight fitting slot 51 of base 14. Back panel 50 is then further secured to deck 20 through the use of two screws extending through tabs 50*b* and engaged with the two threaded retaining points 32*e*. As seen particularly by referring to FIGS. 1 and 4, two side panels 52 and 52' are then secured to base 14 and deck 20. In particular, each panel 52 and 52' include bottom edges 52*a* for friction insertion fitting down into corresponding slots 53 of base 14. As seen by also referring to FIG. 4A, each panel 52 and 52' further include vertically extending tabs 52*b* for tight insertion fitting into slots 16*c* of tank 16. Panels 52 and 52' are secured in such manner by sliding generally in the direction of arrows A in FIG. 4. Both panels 52 and 52' have end vertical edges 52*c* and tabs 52*e* for overlapping engagement with vertical edges 50*b* of rear panel 50. As seen specifically in FIG. 5, a top panel 54 includes a plurality of louvers 54*a*, four tabs 54*b* and a screw hole 54*c*. Panel 54 also includes a hole 55 for a power switch 56 and a hole 57 for a locking mechanism 58. Panel 54 Is slideably secured to panels 52 and 52' wherein tabs 54*b* are inserted into corresponding slots 60 of panels 52 and 52'. Panel 54 also includes two further end tabs, not shown, along a back edge 62 thereof for insertion into slots 64 of rear panel 50. In addition, back edge 62 is overlapped by a top edge 66 of back panel 50. A front merchandising cover 70 includes further louvers 70*a* and a light retaining shelf area 70*b*. A merchandising transparency 72 is releasably securable to cover 70 and can be back-lighted by a fluorescent light fixture 74. Cover 70 also includes an end shoulder extension 76 having a screw hole tab 76*a* and two arcuate perimeter edges 78. In addition, panel 70 includes a pair of tabs 80. Merchandising panel 70 is secured to back panel 50 and side panels 52 and 52' by sliding and insertion engagement there with. In particular, shoulder extension 76 and tab 76*a* extend under a front edge 82 of panel 54 wherein the screw hole 54*c* and the screw hole of tab 76*a* align for receiving a screw 84. Screw 84 is secured into a threaded fitting retained in a component in refrigeration deck 20. It can also be understood that the ends of extension edge 76 are inserted into corresponding slots 86 of panels 52 and 52'. In addition, perimeter edges 78 overlap corresponding perimeter edges 88 of panels 52 and 52'. Projections 89 provide for alignment and support of a front edge 70*c* of panel 70.

A drip tray 90 includes a drain hole tubular extension 90*a* for tight fitting securing insertion into a corresponding drain hole 92 of base 14. A fitting 94 provides for securing thereto of a flexible drain tube, not shown, for delivery of waste liquid to a suitable drain. A drip tray grate 96 rests on tray 90. A splash panel 98 is releasably securable to panel 17 and serves to define a space there between through which ends of syrup coils 24 extend for connection to source of syrup.

Those of skill understand that dispenser capacity is ultimately limited by the ice bank size, the refrigeration capacity and the ambient temperature and humidity that the dispenser is exposed to. In a particular embodiment of the present invention having five valves 12, a nominally rated ⅓ hp compressor that delivers on the order of 1000 to 2000 BTU/hr of cooling capacity depending on ambient condition and amount of ice growth on the evaporator. In that embodiment a maximum ice bank weight of about 20 lbs. provided for. Typically between 3 and 6 twelve ounce drinks can be dispensed while consuming one (1) pound of reserve ice for chilling the drink depending on the ambient condition. Typical dispense rates are from 2 to 4 twelve ounce drinks per minute. In the illustrative example, the evaporator is generally formed from a 0.375 inch OD copper tube of approximately 28 feet in length. The evaporator of the present invention as applied to this particular described embodiment is coiled into inner and outer loops with centerline tube separations of typically 2.875 inches to prevent ice bridging. The ice grows in annular rings with an OD of the ice rings typically controlled to 2.375 inches. This leaves a nominal spacing between the ice rings of 0.500 inches. The baffle in this embodiment is approximately 8 inches on a side having a center hole diameter of 2 to 3 inches. The edge vanes are typically angled upward at 30 to 45 degrees. Some edge vanes can be maintained at 0 degrees if it is desired to preferentially direct the flow of water to reduce ice growth in a certain area of the bath. The baffle is not necessarily square but could be round or rectangular and its shape adjusted to meet the specific needs of the water bath. An example of the water flow is illustrated by the arrows in FIG. 7.

Figure 12:
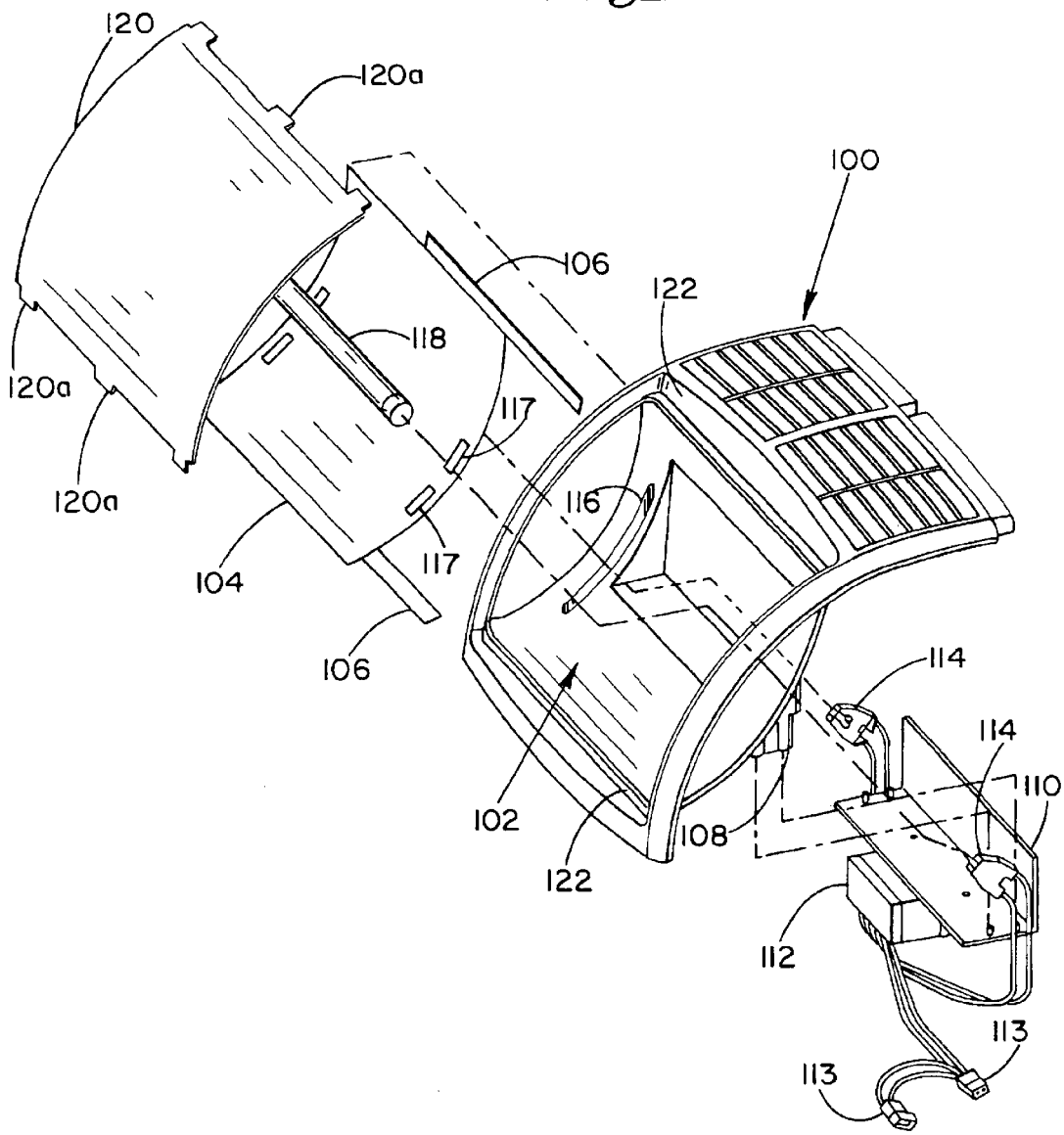
FIG. 12 shows an exploded view of the merchandising cover with the optional lighted display.

As seen by referring to FIG. 12, a further embodiment of the merchandising cover 70 is shown and generally referred to by the numeral 100. Cover 100 includes a generally arcuate concave internal area 102 for receiving therein a rigid arcuate light reflecting sheet 104. Sheet 104 is held therein, for example, by double sided tape strips 106. A rear portion 108 of cover 100 is adapted to receive a bracket 110 securable thereto by screws. Bracket 110 provides for retention thereon of a fluorescent light ballast/ power unit 112 having power connecting plugs 113. A pair of light sockets 114 are also electrically connected to ballast 112 and, when bracket 110 is secured to cover portion 108, extend through openings 116 and are snap fitted to slots 117 of sheet 104 for positioning thereof in area 102. Such snap fitting fluorescent type plugs are known and manufactured, for example, by Vossloh-Schwabe, Inc. of Bridgeville, Pa. as model number 09105. A fluorescent light bulb 118 can then be engaged with sockets 114. An advertising graphic transparency 120 is then secured to cover 100 by, for example, insertion of tabs 120*a* thereof into corresponding slots 122.

An advantage of cover 100 is that it provides for easy retrofitting of a back-lit transparency display thereto. Thus, cover 100 provides for easily converting from a standard opaque type graphic display to one that uses light. Although described herein also as a transparency 72, it can be appreciated that transparency 72 can be configured as a rigid panel for receiving an opaque reflective type graphic. Thus, a transparency 120 can be easily substituted therefor. Also, this lighting adaptation is accomplished in a manner that does not produce an "add-on" look wherein the light is added to or extends from the original surface of the dispenser. Moreover, this lighting adaptation is relatively light in weight, easy to add on and low in cost. Pre-existing power outlets within dispenser 10, not shown, provide for connection to plugs 113. Thus, dispenser 10 can come from the factory ready to provide power to and accept a back-lit display if that option is desired in the future.

Figure 13:
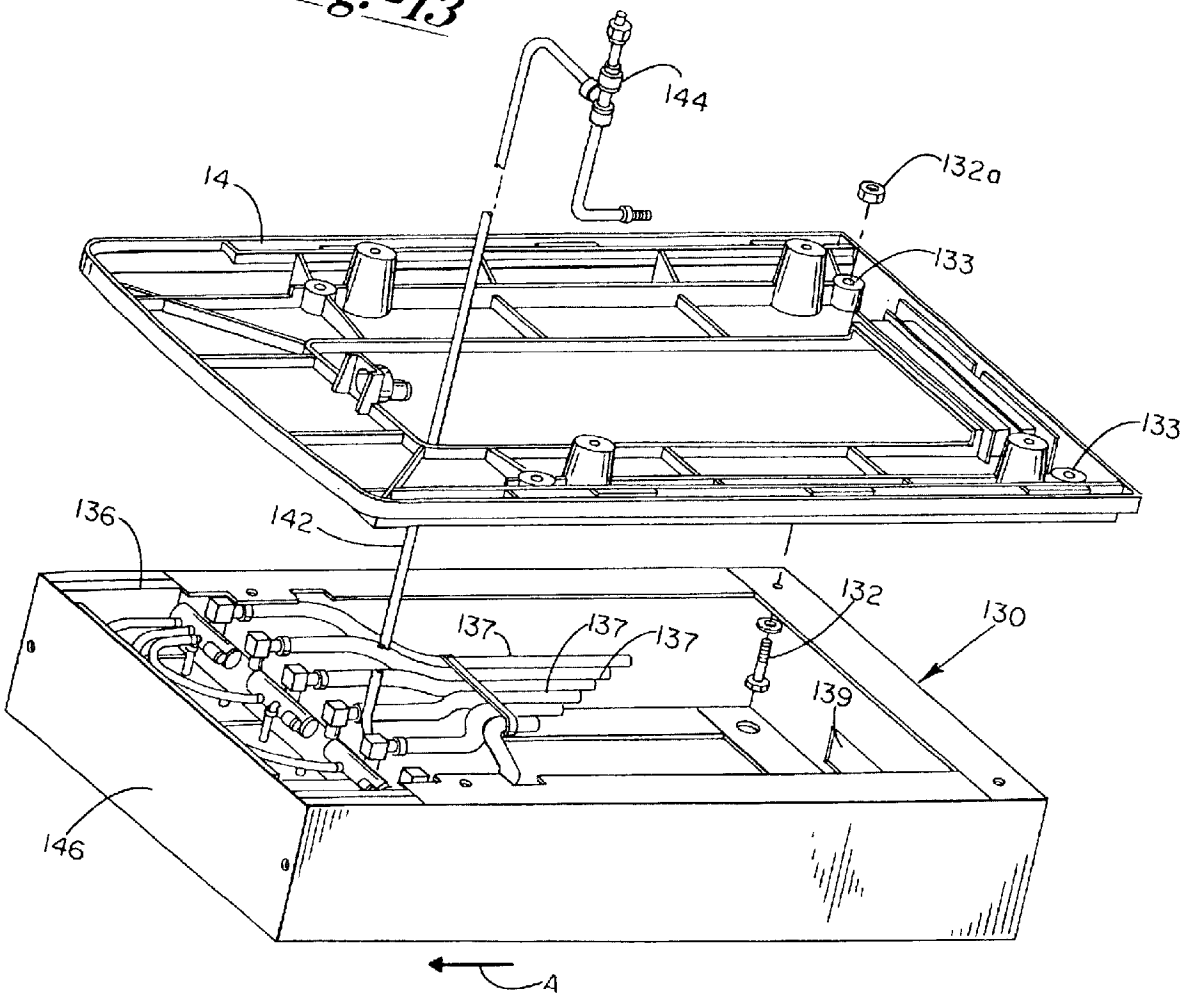
FIG. 13 shows an exploded perspective view of the dispenser base and an optional syrup pump retaining box positioned there below.
Figure 14:
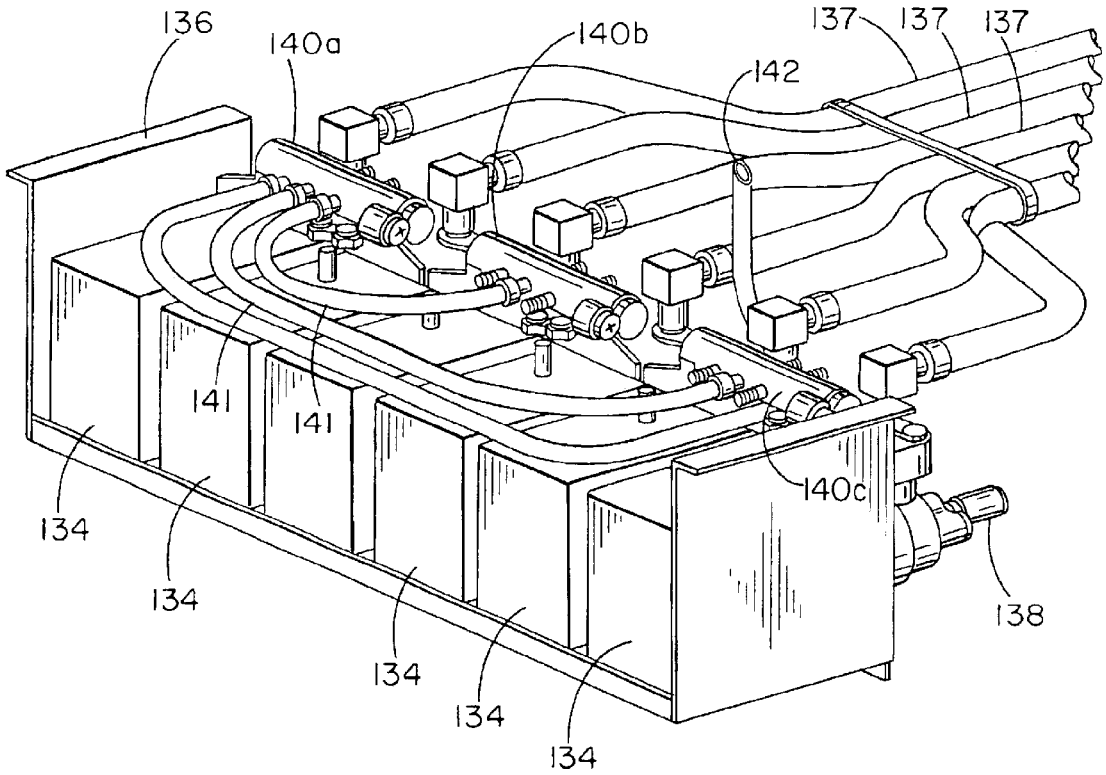
FIG. 14 shows a separate view of the drawer with the syrup pumps thereon.

The present invention also provides for the option of having syrup pumps located therein. As seen by referring to FIGS. 13 and 14, molded plastic base 14 is securable to a pump retaining box 130 by a plurality of fastening means, such as, bolts 132 that cooperate with, for example, nutserts 132*a* retained in pre-existing holes 133 in base 14. Box 130 includes a plurality of pneumatically operated syrup pumps 134, well known in the art, secured to a drawer 136. In the illustrative example, six pumps are shown each having inlet lines 137 for fluid connection to individual sources of syrup, not shown, and outlet lines 138 each for fluid connection to one of the coils 24. As will be appreciated by those of skill, lines 138 extend upward behind splash panel 98 for fluid connection to coils 24. Lines 137 can extend through an opening 139 in box 130 to the sources of syrup.

There are three pneumatic manifolds 140*a*, 140*b* and 140*c* each connected pneumatically in series by lines 141. Pneumatic connections, not shown, provide for pressurized gas delivery to two of the pumps 134 for each manifold 140*a*–140*c*. Manifold 140*c* is connected to a line 142 which is connected to a T-fitting 144 which permits connection of a source of pressurized carbon dioxide gas to both the pumps 134 and carbonator 26.

Drawer 136 is slideably engaged with box 130 and is accessible by a removable plate 146. After removal of plate 146, drawer 136 can be moved in the direction of arrow A in FIG. 13 for facilitating repair or replacement of pumps 134. By having a separate box 130, dispenser 10 can be easily retrofitted with optional "internal" syrup pumps where that configuration is desired. Thus, dispenser 10 need not be built specifically at the factory with or without internal syrup pumps. The T-fitting 144 provides for easy connection to the pressurized source of carbon dioxide gas that provides such gas to carbonator 26. Drawer 136 can be completely removed from box 130 and pumps 134 are located directly behind access plate 146, thus positioned below driptray 90. This design provides for quick and easy access to pumps 134 for repair or replacement thereof. The present embodiment shows pneumatically driven syrup pumps 134, whereas those of skill will appreciate that electrically driven pumps could also be used.

It can be appreciated that the present invention provides for ease of assembly of a beverage dispenser. The various exterior panels or cladding are directly secured to the dispenser components including the water bath tank and the base. Thus, no additional or intermediate framework is needed to secure the panels thereto. In addition, the entire refrigeration deck is quickly secured to and properly positioned on the water bath tank by clips secured to tabs extending through corresponding slots in the component platform. The evaporator herein provides for maximum heat exchange between the water and ice bank. Such exchange is further enhanced by the flow baffle of the present invention.

What is claimed is:

1. A device for cooling a flow of a liquid, comprising:

a water bath tank for holding a volume of water in an interior thereof, a refrigeration system including an evaporator positioned within the water bath tank so that cooling of the evaporator by operation of the refrigeration system results in ice formation on the evaporator, an ice sensor and control for regulating the formation of ice on the evaporator, a fluid cooling coil positioned in the tank beneath the evaporator and extending along a portion of a bottom end surface of the water bath tank for carrying the flow of fluid there through for providing heat exchange cooling thereof, a baffle plate positioned on a top surface of the cooling coil, the baffle plate having one or more angled perimeter edge flanges, an agitator for providing movement of the water in the water bath tank in an initial downward direction towards the baffle plate so that the water contacts a top surface of the baffle plate and is then directed in a upward direction by the one or more angled perimeter flanges towards the evaporator for providing enhanced heat exchange cooling of the water in the water bath tank by the ice formed on the evaporator.

2. The device as defined in claim 1, and the water bath tank having vertical sidewalls and the ice formed on the evaporator for creating a water flow space between the vertical sidewalls and the ice formed on the evaporator into which water flow space a flow of water is directed by the one or more baffle plate angled perimeter flanges.

3. The device as defined in claim 1, and the baffle plate extending over substantially all of the top surface of the fluid cooling coil.

4. The device as defined in claim 3, and the baffle plate extending over substantially all of the top surface of the fluid cooling coil.

5. The device as defined in claim 1, and the evaporator having a plurality of coil sections spaced a predetermined distance from each other to resist the formation of ice bridges there between.

6. The device as defined in claim 5, and the water bath tank having vertical sidewalls and the ice formed on the evaporator for creating a water flow space between the vertical sidewalls and the ice formed on the evaporator into which water flow space a flow of water is directed by the one or more baffle plate angled perimeter flanges.

7. The device as defined in claim 5, and the baffle plate extending over substantially all of the top surface of the fluid cooling coil.

8. The device as defined in claim 6, and the baffle plate extending over substantially all of the top surface of the fluid cooling coil.

9. The device as defined in claim 1, and the evaporator having a plurality of inner coil sections and a plurality of outer coil sections wherein predetermined spacing is maintained between the inner coil sections, between the outer coils sections and as between the inner coil and outer coil sections to resist any formation of ice bridges between any of the coil sections of the evaporator.

10. The device as defined in claim 9, and the water bath tank having vertical sidewalls and the ice formed on the evaporator for creating a water flow space between the vertical sidewalls and the ice formed on the evaporator into which water flow space a flow of water is directed by the one or more baffle plate angled perimeter flanges.

11. The device as defined in claim 9, and the baffle plate extending over substantially all of the top surface of the fluid cooling coil.

12. The device as defined in claim 10, and the baffle plate extending over substantially all of the top surface of the fluid cooling coil.

13. The device as defined in claim 1, and the baffle plate having one or more holes for permitting the water in the water bath to flow there through for enhancing the heat exchange cooling of the fluid cooling coil.

14. The device as defined in claim 2, and the baffle plate having one or more hole for permitting the water in the water bath to flow there through for enhancing the heat exchange cooling of the fluid cooling coil.

15. The device as defined in claim 3, and the baffle plate having one or more holes for permitting the water in the water bath to flow there through for enhancing the heat exchange cooling of the fluid cooling coil.

16. The device as defined in claim 5, and the baffle plate having one or more holes for permitting the water in the water bath to flow there through for enhancing the heat exchange cooling of the fluid cooling coil.

17. The device as defined in claim 6, and the baffle plate having one or more holes for permitting the water in the water bath to flow there through for enhancing the heat exchange cooling of the fluid cooling coil.

* * * * *